US005470034A

United States Patent [19]

Reeves

[11] Patent Number: 5,470,034

[45] Date of Patent: Nov. 28, 1995

[54] RAILWAY TRACK CIRCUITS

[75] Inventor: Malcolm Reeves, Chippenham, United Kingdom

[73] Assignee: Westinghouse Brake & Signal Holding Ltd., United Kingdom

[21] Appl. No.: 219,217

[22] Filed: Mar. 29, 1994

[30] Foreign Application Priority Data

May 20, 1993 [GB] United Kingdom ..... 9310439

[51] Int. Cl.[6] ..... B61L 25/00

[52] U.S. Cl. ..... 246/122 R; 246/28 R; 246/34 R

[58] Field of Search ..... 246/20, 28 R, 246/246, 249, 255, 122, 41, 58, 34 R, 34 A, 34 B, 34 CT, 39, 124, 46, 50, 51

[56] References Cited

U.S. PATENT DOCUMENTS 3,359,416 12/1967 Wilcox ..... 246/122 R
3,450,874 6/1969 Whitten ..... 246/122 R
3,829,682 8/1974 Geiger ..... 246/125
4,145,018 3/1979 Poggio et al. .
4,641,803 2/1987 Brown et al. ..... 246/122 R

FOREIGN PATENT DOCUMENTS 1411856 8/1965 France .
2134681 8/1984 United Kingdom .

*Primary Examiner*—Mark T. Le
*Attorney, Agent, or Firm*—Welsh & Katz, Ltd.

[57] ABSTRACT

This invention relates to railway track circuits. An active track circuit termination unit (4) is connected to the rails and, via a transmitter unit (4*a*), transmits signals into the rails to terminate track circuits (A,B). The transmitter unit also transmit data signals, for example track circuit signals, into the track circuits.

9 Claims, 2 Drawing Sheets

RAILWAY TRACK CIRCUITS

Figure 1:
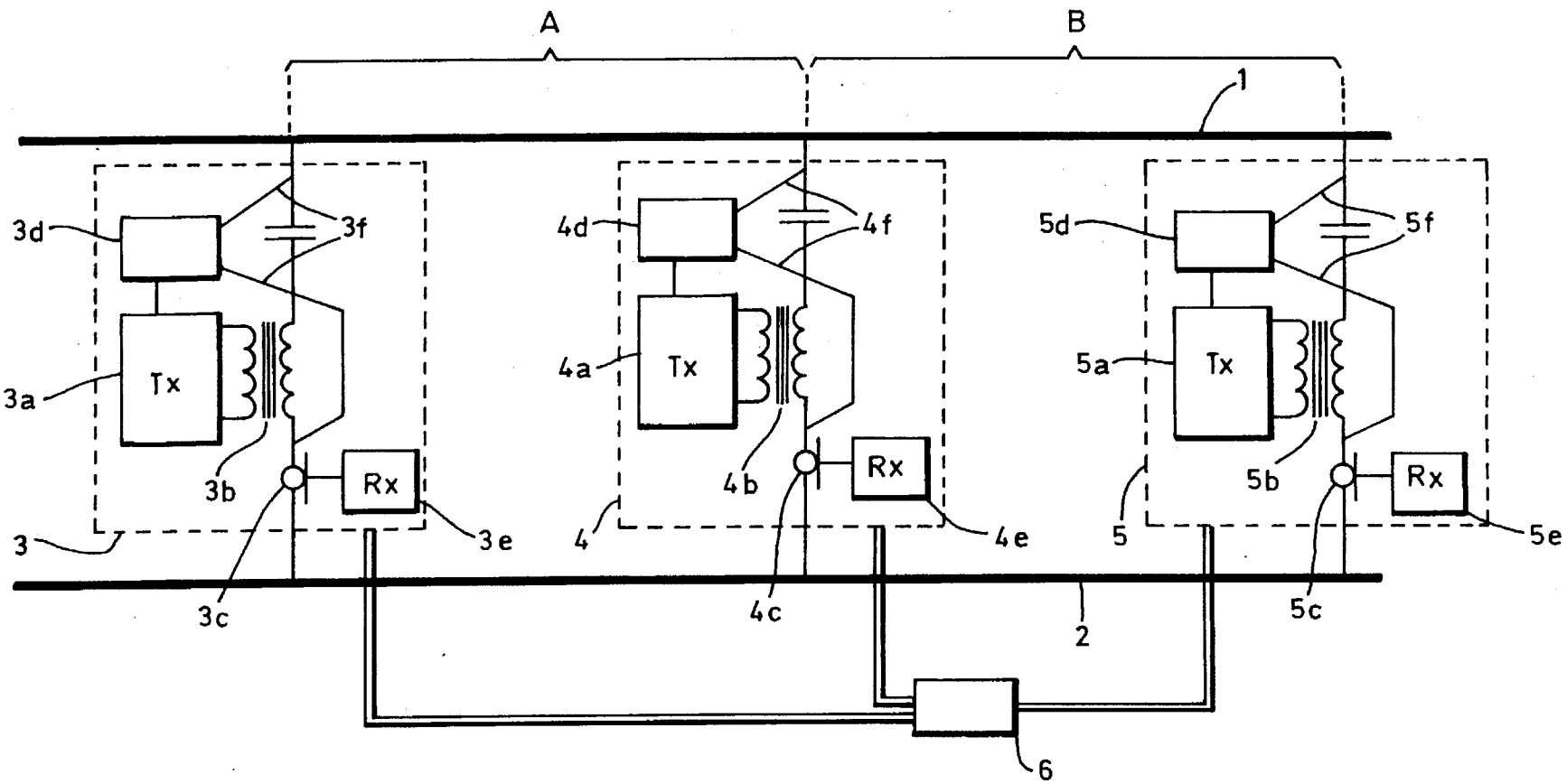

This invention relates to railway track circuits.

Railway track circuits are used to detect the presence and/or position of railway vehicles in a length of railway track. In a typical track circuit system, the track is divided into several track circuit sections, in each of which at one location a transmitter of electrical signals is coupled with the rails and at another location a receiver is coupled with the rails. When a railway vehicle is in the track circuit section of track it electrically connects the rails of the circuit to each other and this is detected by the receiver as a change in the signal received from the transmitter.

Where the railway tracks are not jointless, adjacent track circuit sections may be separated merely by insulative breaks in the rails. In jointless railways, track circuit sections are conventionally separated by providing, at the boundaries between track circuit sections, passive connections across the rails which present low impedances to signals of the frequency at which the track circuit operates. These prevent such signals propagating past the connections, from one track circuit section to another. The passive connections may comprise either a shorting bar which connects the rails directly together or an electrical filter having a suitable impedance. Usually the shorting bar arrangement is resonated by the addition of a capacitor some distance from the bar in order to increase the rail-to-rail voltage because a high voltage is necessary to break down the oxide film which is present between the train's wheels and the rails.

Where the railway vehicles are electrically powered, the vehicles' traction power (which may be supplied to the vehicles by, for example, a catenary wire over the tracks) may be returned to the substation via the rails. In this case it is necessary to connect the rails so as to balance the return traction current between them. Where the rails are connected by shorting bars as part of a track circuit system these can also serve as connectors in the traction circuit. However, where the rails are connected by electrical filters, which are tuned to present a low impedance at the frequency at which the track circuit system operates, secondary ("impedance bond") connectors which present a low impedance at the frequency of the traction circuit and a high impedance at track circuit frequencies are needed. Both of these systems of track circuit connection have disadvantages. The desired boundaries between track circuit sections may not coincide with the desired positions of the connectors for the traction circuit, which means that compromises have to be made where shorting bars are to be used. The filter system is inconvenient to manufacture because the filters must be tuned to match the frequencies of the transmitters.

According to the present invention there is provided a termination apparatus for terminating a track circuit by acting as an active element of the track circuit. By replacing the passive track circuit termination of the prior art this apparatus allows the above-mentioned problems of the prior art to be overcome.

In use, the termination apparatus is suitably connected between the rails of the track, suitably at the position where the track circuit is to be terminated. The termination apparatus suitably comprises first and second connections, each for connection to one of the rails. The termination apparatus may suitably be capable of uncoupling itself from at least one of the rails if it determines that it has failed, to ensure that the remainder of the track circuit system can continue to operate.

The termination apparatus suitably includes power amplifier means for connection to act as an active component of the track circuit. The termination apparatus preferably comprises: power amplifier means for transmitting signals into a track circuit to be terminated; feedback means for producing a feedback signal in dependence on signals in the track circuit; and control means for, in dependence on the feedback signal, controlling the power amplifier means to transmit a termination signal into the track circuit to terminate the track circuit. The nature of the termination signal is suitably determined by the control means, so as to have the effect of terminating the track circuit.

Preferably the termination apparatus includes a transformer via which the power amplifier means may be connected to the rails.

Preferably, the control means includes means for receiving data defining a data signal for transmission into the track circuit. Preferably, the control means controls the power amplifier means to transmit both the termination signal and the data signal into the track circuit.

Preferably, the termination apparatus includes receiving means for receiving data signals transmitted into the track circuit from other units.

The power amplifier means may suitably be restricted to transmit signals of a power not greater than a predetermined power limit, to allow it to continue to operate when coupled between the rails when the impedance between the rails at the location where it is coupled is periodically low, for example when a train passes over. Preferably, the power amplifier means is capable of increasing the frequency of the track circuit signals it transmits, and/or increasing the effective impedance it presents to track circuit signals, in response to the power of the signals it transmits approaching the power limit or to the impedance between the rails at its location becoming low.

A railway track circuit may suitably be terminated solely by active termination apparatus according to the present invention, i.e. with no passive termination, or with a combination of active and passive termination. When solely active termination is used, no termination of the track circuit is tuned and therefore a larger bandwidth is available for the transmission of ATP (Automatic Train Protection) or other data signals. Transmitters of signals into the track circuit may then use different frequencies at which to transmit their signals (or another technique may be adopted) to allow the signals to be distinguished. Another advantage resulting from the increased bandwidth is that spread spectra signals may be transmitted, or frequency hopping may be used, to overcome traction noise.

Figure 2:
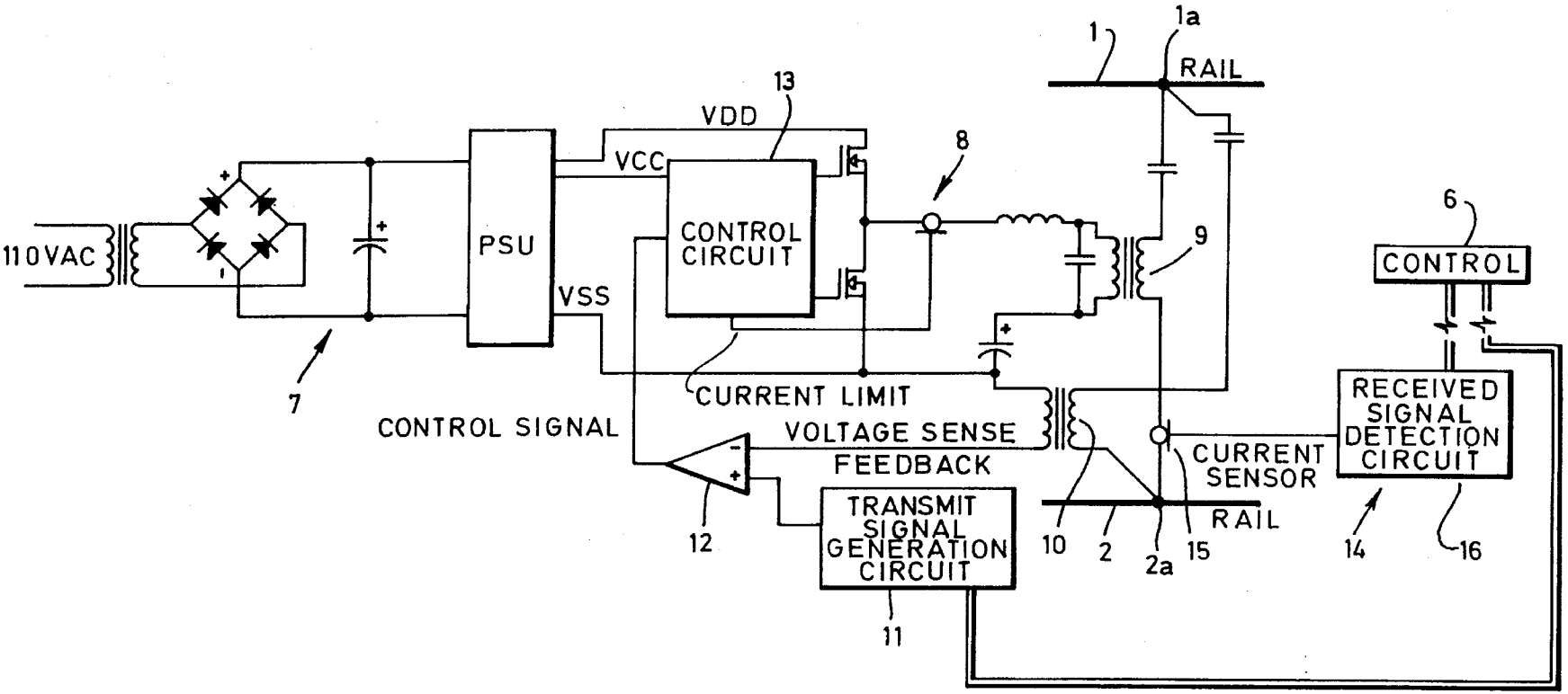

The present invention will now be described by way of example with reference to the accompanying drawings, in which:

FIG. 1 is a schematic diagram of a track circuit system including active termination units; and FIG. 2 is a schematic diagram of a termination unit as indicated in FIG. 1.

FIG. 1 shows two side-by-side rails 1,2 separated into track circuits (indicated generally by A, B) by active termination units 3,4,5 (shown schematically), each of which is connected between the rails. Track circuit A is terminated by termination units 3 and 4, and track circuit B is terminated by termination units 4 and 5. Termination unit 4 acts so as to terminate both track circuits A and B.

Each termination unit is an active component of at least one track circuit and includes a transmitter unit 3*a*, 4*a*, 5*a* which is connected between the rails via a transformer 3*b*, 4*b*, 5*b*; and a control unit 3*d*, 4*d*, 5*d* that is in a feedback path 3*f*, 4*f*, 5*f* between the rails 1,2 and that, in dependence on the signals it senses in the feedback path controls the respective transmitter unit to transmit a termination signal (to terminate the track circuit(s)). Control units 3*d*, 4*d*, 5*d* may also receive, from a supervisory unit 6, data defining a data signal to be transmitted into the track circuits. Alternatively, the control units could generate the data themselves. The control units can then control the respective transmitter unit to transmit the data signal defined by the data. The data signal could be an ATP signal and/or a conventional track circuit signal for allowing the presence or position of railway vehicles to be detected.

Receiving units 3*e*, 4*e*, 5*e* having current sensors 3*c*, 4*c*, 5*c* are also provided, for sensing data signals received from other units (either similar termination units or different units). These signals can be used to pass signalling information and to detect the presence, position and status of railway vehicles. Data relating to the signals, as detected by the receiving units, can be relayed to the supervisory unit 6.

Each termination unit is therefore capable of terminating adjacent track circuit sections (at the ends of which it is connected) by preventing the propagation of signals between them; transmitting data signals; and receiving data signals transmitted by other units. Thus, the current through a termination unit's connections with the rails has two components: a received component generated by other units and a transmitted component generated by its own transmitter unit.

The embodiment illustrated in FIG. 1 has active termination at both ends of each track circuit shown, but this is not essential: a combination of active and passive termination could be used in a single track circuit. However, the illustrated arrangement has the advantage that since there is a transmitter of track circuit signals at both ends of each track circuit the rail to rail voltage is more uniformly high throughout the track circuits than if passive termination were used. Also, since at both ends of each track circuit there is a receiver for detecting vehicles' positions the system gives greater safety than prior, passive systems with only one receiver.

The propagation of signals past a termination unit can be reduced to a minimum, to terminate adjacent track sections, by the use of negative feedback to the transmitter unit of the termination unit. This allows the effective impedance of the termination unit to be reduced to zero ohms (or thereabouts) at the frequencies which it is intended to prevent from propagating. However, this can present a disadvantage. When a railway vehicle which is to be detected in the track circuit connects the rails together its impedance in connecting the rails is typically 0.5 Ω or less. If the vehicle is far from a termination unit then the impedance between the rails as detected by that unit will be greater because of the impedance of the intervening portions of rail. However, as the vehicle nears the termination unit, the detected impedance will approach 0.5 Ω or less. Then, the transmitter unit of the termination unit will have to transmit signals at high power if it is to generate track circuit signals to the adjacent termination unit which is to receive the signals.

To overcome this, the transmitter unit may be restricted to a predetermined power limit. Then, either the output impedance of the transmitter unit may be raised as the transmitter unit approaches its power limit, so that less power is then required of it, or (since the presence of vehicles on the track attenuates high frequency signals less than low frequency signals) the frequency of the track circuit signals can be increased. Alternatively, when the power limit is reached the vehicle may be assumed to be at or very near the termination unit, in which case it may be decided that there is then no need for the adjacent unit to receive signals to determine the vehicle's position and the output voltage of the transmitter unit may merely be restricted.

Each active termination unit can be arranged to uncouple itself from at least one of the rails if it determines that it has failed, joining together into a single, lengthened track circuit the track circuits which were on either side of the failed termination unit. In this condition the active termination units adjacent to the failed unit terminate the lengthened track circuit. Provided the system can cope with the greater attenuation of such lengthened track circuit sections it should still function correctly.

Two active termination units may be provided at each location in the system where one is needed so that if one fails the "spare" can be switched into operation.

A system employing active termination units may be installed to replace an existing, passive termination system without affecting the operation of the existing system. When the installation of the replacement system is complete the existing system can be disconnected and the replacement system powered up, to turn it on. The fact that each active termination unit has fewer connections to the rails than prior art systems also saves installation effort.

FIG. 2 shows in more detail than FIG. 1 the configuration of an active termination unit. Power for the unit comes from a 110 V a.c. supply and is converted to suitable d.c. levels by the power supply unit 7. An amplifier 8 drives the rails 1, 2 of the track via an isolation transformer 9 and track connections 1*a*, 2*a*. A feedback signal comes via a second isolation transformer 10 and is combined with a transmit requirement signal (relating to the data signal to be transmitted and generated by a transmit signal generator 11) by an op-amp 12 to generate a control signal. The control signal is used by a control circuit 13 to control the amplifier 8 to ensure that the output to the rails matches the transmit requirements—i.e. that the required termination and data signals are transmitted. The amplifier is preferably a switch-mode type, as this minimizes the power loss. The unit also includes a received signal circuit 14 which includes a current sensor 15 feeding a detection circuit 16. This extracts data concerning the occupancy of the track circuit(s) to which the termination unit is connected and passes it to a supervisory unit 6 which uses the data to interlock the railway's signalling system. The supervisory unit may also transmit data to the transmit signal generator 11 to control the output of data signals into the track circuit.

I claim:

1. A railway track circuit arrangement comprising:

a) first and second rails of a railway track;

b) a first track circuit comprising:

i) a first transmitter, for transmitting signals into said rails at one end of said first track circuit; and ii) a first receiver, for receiving signals from said rails at an opposite end of said first track circuit; and c) a second track circuit adjacent said first track circuit and comprising:

i) a second transmitter, for transmitting signals into said rails at an end of said second track circuit adjacent said opposite end of said first track circuit; and ii) a second receiver, for receiving signals from said rails at an opposite end of said second track circuit; wherein:

d) said second transmitter comprises part of termination apparatus for the first and second track circuits, said termination apparatus preventing the passage of signals between said first and second track circuits as well as providing said second transmitter as an active element of said second track circuit.

2. A railway track circuit arrangement according to claim 1, wherein said second transmitter comprises power amplifier means for supplying power into said second track circuit to terminate said second track circuit.

3. A railway track circuit arrangement according to claim 2, wherein said termination apparatus includes a first connection to one of said first and second rails and a second connection to the other of said first and second rails, said power amplifier means supplying power between said first and second connections.

4. A railway track circuit arrangement according to claim 3, wherein said power amplifier means is connected to said first and second rails via a transformer.

5. A railway track circuit arrangement according to claim 2, wherein said power amplifier means is limited so as to transmit signals only of a power less than a predetermined power limit.

6. A railway track circuit arrangement according to claim 5, wherein said power amplifier means is capable, in response to the power of the signals said power amplifier means is required to transmit approaching said power limit, of increasing the frequency of signals transmitted by said power amplifier means.

7. A railway track circuit arrangement according to claim 3, including:

feedback means for producing a feedback signal in dependence on signals in said second track circuit; and control means for, in dependence on said feedback signal, controlling said power amplifier means to transmit a termination signal into said second track circuit to terminate said second track circuit.

8. A railway track circuit arrangement according to claim 7, wherein said control means is capable of controlling said power amplifier means to transmit data signals into said second track circuit.

9. A railway track circuit arrangement according to claim 8, wherein said data signals comprise signals selected from the group consisting of track circuit signals and ATP signals.

* * * * *